US011982213B2

(12) United States Patent
Hu

(10) Patent No.: US 11,982,213 B2
(45) Date of Patent: May 14, 2024

(54) LUBRICATING METHOD OF LUBRICATION SYSTEM OF ENGINE

(71) Applicant: YONGKANG PUYUAN TOOLS CO., LTD., Jinhua (CN)

(72) Inventor: Quanyu Hu, Jinhua (CN)

(73) Assignee: YONGKANG PUYUAN TOOLS CO., LTD., Jinhua (CN)

( * ) Notice: Subject to any disclaimer, the term of this patent is extended or adjusted under 35 U.S.C. 154(b) by 0 days.

(21) Appl. No.: 18/090,670

(22) Filed: Dec. 29, 2022

(65) Prior Publication Data

US 2023/0212966 A1 Jul. 6, 2023

(30) Foreign Application Priority Data

Dec. 31, 2021 (CN) ..... 202111673540.2

(51) Int. Cl.
*F01M 1/04* (2006.01)
*F01M 1/08* (2006.01)

(52) U.S. Cl.
CPC ..... *F01M 1/04* (2013.01); *F01M 1/08* (2013.01)

(58) Field of Classification Search
CPC ..... F02B 2075/027; F02B 63/02; F02B 2275/20; F01M 1/04; F01M 1/16
See application file for complete search history.

(56) References Cited

U.S. PATENT DOCUMENTS

2015/0136065 A1* 5/2015 Kong ..... F01M 11/02 123/196 CP

FOREIGN PATENT DOCUMENTS

| | | | | |
|---|---|---|---|---|
| CN | 201635791 | U | * | 11/2010 |
| CN | 202017563 | U | * | 10/2011 |
| CN | 102230406 | A | | 11/2011 |
| CN | 102889136 | A | * | 1/2013 |
| CN | 203427609 | U | * | 2/2014 |
| CN | 109707478 | A | * | 5/2019 |
| CN | 214147366 | U | * | 9/2021 |
| JP | 2017180092 | A | * | 10/2017 |
| TW | M541505 | U | * | 5/2017 |

* cited by examiner

*Primary Examiner* — George C Jin
*Assistant Examiner* — Teuta B Holbrook
(74) *Attorney, Agent, or Firm* — Birchwood IP

(57) ABSTRACT

The present disclosure discloses a lubricating method of a lubrication system of an engine. A first check valve unidirectionally leading to an oil chamber is arranged between a crankshaft chamber and the oil chamber; a first lubricating oil circuit that communicates the oil chamber and the cam chamber is arranged in the crankcase, and the cam chamber is communicated with an upper rocker arm chamber through a tappet hole; an oil pipe connected to the first lubricating oil circuit is arranged in the oil chamber; when the pressure in the crankshaft chamber is increased, the first check valve is opened, engine oil enters the oil chamber from the crankshaft chamber; and the pressure in the oil chamber is increased accordingly, the engine oil enters the first lubricating oil circuit and the cam chamber through the oil pipe for lubricating the cam chamber.

10 Claims, 7 Drawing Sheets

LUBRICATING METHOD OF LUBRICATION SYSTEM OF ENGINE

CROSS-REFERENCE TO RELATED APPLICATIONS

This is a U.S. patent application which claims the priority and benefit of Chinese Patent Application Number 202111673540.2, filed on Dec. 31, 2022, the disclosure of which is incorporated herein by reference in its entirety.

TECHNICAL FIELD

The present disclosure relates to a lubricating method of a lubrication system of an engine.

BACKGROUND

At present, as for a hand-held engine, in consideration of exhaust emission control, a four-stroke engine is a better choice. However, the four-stroke engine must use separate lubricating oil. During the use of this hand-held tool, a machine will operate at different angles. We must ensure that the engine will be lubricated well at different stations, and a balance pipe will not spray too much oil.

In the process of research and practice of this method, it is found that small four-stroke engines in the market are not lubricated sufficiently, resulting in short engine durability, cylinder piston locking, and large amount of oil injection from the balance pipe.

CN102230406A discloses a patent of invention named "Hand-held four-stroke engine lubricating system". In the engine, a crankcase chamber, a valve distribution chamber, and a rotary valve are arranged. However, an oil return channel of a valve chamber with such structure is not reasonable, which causes a lot of oil to flow out of the engine through an exhaust pipe.

SUMMARY

In order to solve the problems of engine lubrication and lubricating oil circulation, and reduce oil consumption of an engine, the present disclosure provides a lubricating method of a lubrication system of an engine.

The technical solution of the present disclosure to solve existing problems is as follows: provided is a lubricating method of a lubrication system of an engine, as an improvement, an oil chamber is arranged on a crankcase, a first check valve with an oil circuit unidirectionally leading to the oil chamber is arranged between a crankshaft chamber and the oil chamber, a first lubricating oil circuit is arranged between the oil chamber and a cam chamber; the cam chamber is communicated with an upper rocker arm chamber through a tappet hole;

an oil return circuit that communicates the upper rocker arm chamber and the crankshaft chamber in the crankcase is arranged on a cylinder, and a second check valve which can unidirectionally lead to the crankshaft chamber from the upper rocker arm chamber is arranged in the oil return circuit; and when a piston goes up, the pressure in the crankshaft chamber is reduced, the first check valve is closed, and oil mist in the upper rocker arm chamber returns to the crankshaft chamber through the oil return circuit and the second check valve.

As a further improvement, when the piston goes down, the pressure in the crankshaft chamber is increased, the first check valve is opened, and engine oil enters the oil chamber from the crankshaft chamber; the pressure in the oil chamber is increased accordingly, the engine oil enters the first lubricating oil circuit through an oil pipe and enters the cam chamber from the first lubricating oil circuit for lubricating the cam chamber, and oil mist enters the upper rocker arm chamber through the tappet hole for lubricating the upper rocker arm chamber; and when the piston goes up, the pressure in the crankshaft chamber is reduced, the first check valve is closed, and the oil mist in the upper rocker aim chamber returns to the crankshaft chamber through the oil return circuit and the second check valve, completing a cycle.

As a further improvement, a cylinder head and an inner cylinder head are arranged on the top of the cylinder, a top head cavity is arranged between the cylinder head and the inner cylinder head, and a third lubricating oil circuit with one end communicating with the top head cavity is arranged on the inner cylinder head; a second lubricating oil circuit with one end communicating with the other end of the third lubricating oil circuit is arranged in the cylinder, the second check valve is arranged in the second lubricating oil circuit, and the second lubricating oil circuit and the third lubricating oil circuit form the oil return circuit; when the piston goes down, the pressure in the crankshaft chamber is increased, the first check valve is opened, and the engine oil enters the oil chamber from the crankshaft chamber; the pressure in the oil chamber is increased accordingly, the engine oil enters the first lubricating oil circuit through the oil pipe, then enters the cam chamber through the first lubricating oil circuit, and then enters the upper rocker arm chamber through the tappet hole; under the action of pressure, the atomized oil mist further enters the top head cavity from the upper rocker arm chamber through an oil channel; and when the piston goes up, the pressure in the crankshaft chamber is reduced, the first check valve is closed, and the oil mist in the top head cavity returns to the crankshaft chamber through the third lubricating oil circuit, the second lubricating oil circuit and the second check valve to realize oil return of an oil return channel, completing a cycle.

As a further improvement, the first lubricating oil circuit is arranged on the crankcase; and an oil pipe connected to a corresponding port of the first lubricating oil circuit is arranged in the oil chamber.

As a further improvement, a threshold for opening a corresponding check valve is set fir the first or/and second check valve(s); and a reed valve is used as the first check valve.

As a further improvement, a third check valve is arranged between the upper rocker arm chamber and an air filter; when the piston goes up, the pressure in the crankshaft chamber is reduced, the first check valve is closed, the oil mist in the upper rocker arm chamber returns to the crankshaft chamber through the oil return circuit and the second check valve, the third check valve is closed to disconnect the air filter from the upper rocker arm chamber; and a threshold for opening the third check valve is set for the third check valve.

As a further improvement, at least one oil inlet column is arranged on the inner cylinder head, at least one of the oil inlet columns protrudes into the bottom of the upper rocker arm chamber, and an oil inlet channel that communicates the upper rocker arm chamber and the top head cavity is arranged on the oil inlet column; and at least one oil inlet hole that communicates the upper rocker arm chamber and the top head cavity is arranged on the top wall of the inner cylinder head, and the oil inlet column 1 or/and the oil inlet hole form(s) an oil channel that communicates the top head cavity and the upper rocker arm chamber.

As a further improvement, the oil pipe is spiral, one end of the oil pipe is connected to a corresponding end of the first lubricating oil circuit, and a gravity member is arranged at an oil inlet of the other end.

As a further improvement, the first check valve is installed on a case cover arranged on the crankcase; a reed installation surface of the first check valve is installed at a certain angle to a case closing surface, with the angle being greater than 10 degrees and less than 80 degrees; and a rubber check valve is used as the second check valve.

As a further improvement, an inlet of the first check valve is arranged on the wall of the crankshaft chamber, and an outlet of the first check valve is arranged inside the oil chamber; the first lubricating oil circuit is arranged in the crankcase, and an oil nozzle is arranged on the first lubricating oil circuit; and a threshold of the first and second check valves is set to 0.10 MPa.

Compared with the prior art, the present disclosure has the following beneficial effects: the first check valve with the oil circuit unidirectionally leading to the oil chamber from the crankshaft chamber is arranged between the crankshaft chamber and the oil chamber; the first lubricating oil circuit that communicates the oil chamber and the cam chamber is arranged in the crankcase, and the cam chamber is communicated with the upper rocker arm chamber through the tappet hole; the oil pipe connected to the first lubricating oil circuit is arranged in the oil chamber; in this way, when the pressure in the crankshaft chamber is increased, the first check valve is opened, the engine oil enters the oil chamber from the crankshaft chamber; the pressure in the oil chamber is increased accordingly, the engine oil enters the first lubricating oil circuit through the oil pipe and enters the cam chamber through the first lubricating oil circuit for lubricating the cam chamber. The lubricating oil or oil mist enters the upper rocker arm chamber through the tappet hole for lubricating the upper rocker arm chamber.

Further, an oil return circuit unidirectionally leading to the crankshaft chamber is arranged between the upper rocker arm chamber and the crankshaft chamber, and a second check valve unidirectionally leading to the crankshaft chamber is arranged in the oil return circuit. In this way, when the piston goes up, the pressure in the crankshaft chamber is reduced, the first check valve is closed, the pressure in the crankshaft chamber is negative relative to that in the upper rocker arm chamber. The negative pressure in the crankshaft chamber makes the oil mist in the upper rocker arm chamber return to the crankshaft chamber through the oil return circuit and the second check valve to complete a cycle, so as to fully lubricate and cool each mechanism of the entire engine. Due to the oil return circuit, when the engine turns 360 degrees, the oil mist mixture in the upper rocker arm chamber can still return to the crankshaft chamber normally through the oil return circuit to achieve lubrication.

In addition, as for the crankshaft chamber with negative pressure relative to that in the upper rocker arm chamber, the oil mist in the upper rocker arm chamber is forced to return to the crankshaft chamber through the oil return circuit and the second check valve, which reduces the pressure in the upper rocker arm chamber, reduces the oil flowing out of the engine through the balance pipe, and reduces the oil. consumption of the engine.

DETAILED DESCRIPTION

Figure 1:
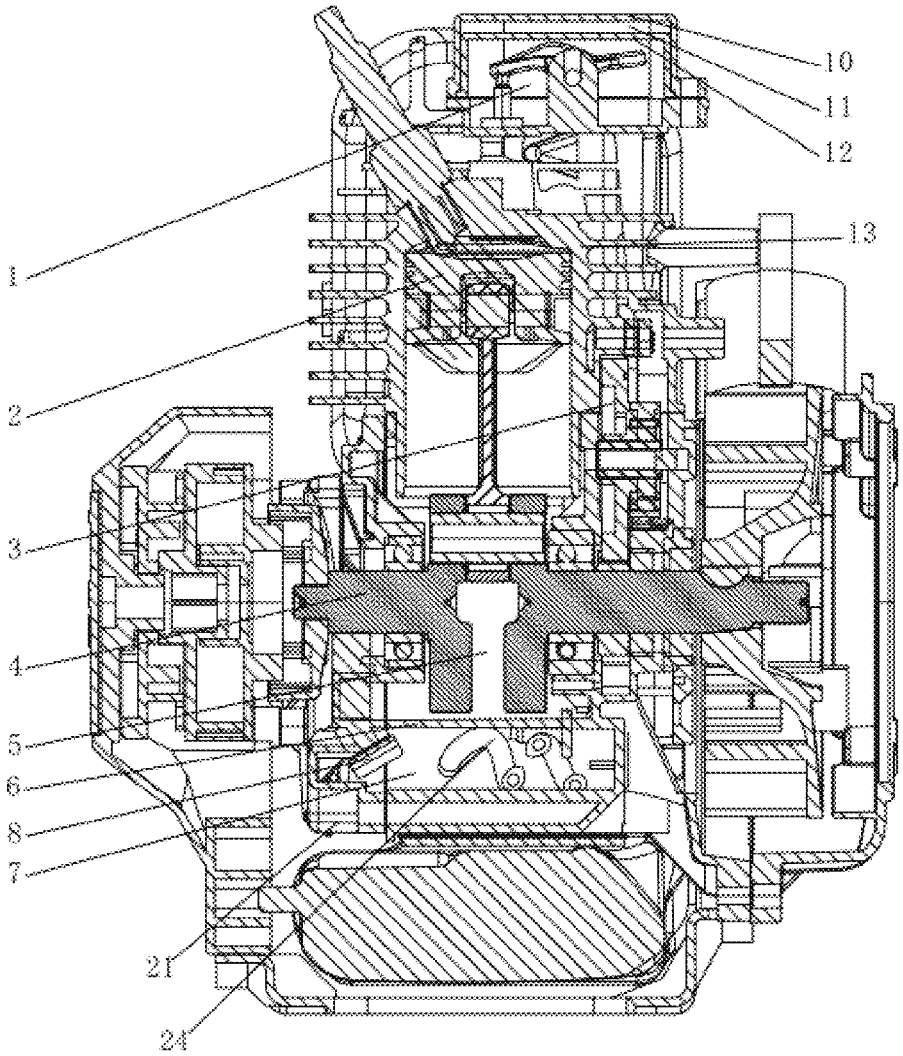
FIG. 1 is a cross sectional view of an engine along the centerline of a crankshaft of the present disclosure.
Figure 2:
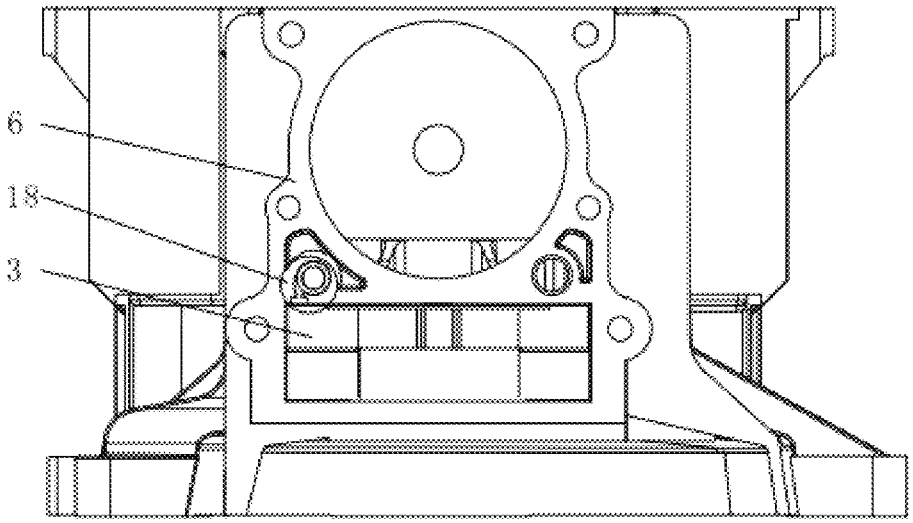
FIG. 2 is a view of a case of the present disclosure.

Referring to FIGS. 1-12, in this embodiment, provided is a lubricating method of a lubrication system of an engine. An oil chamber 7 is arranged on a crankcase 6. A first check valve 8 with an oil circuit unidirectionally leading to the oil chamber 7 is arranged between a crankshaft chamber 5 and the oil chamber 7. A first lubricating oil circuit 14 is arranged between the oil chamber 7 and a cam chamber 3. The cam chamber 3 is communicated with an upper rocker arm chamber 1 through a tappet hole.

An oil return circuit that communicates the upper rocker arm chamber 1 and the crankshaft chamber 5 in the crankcase 6 is arranged on a cylinder 13. A second check valve 17 which can unidirectionally lead to the crankshaft chamber 5 from the upper rocker arm chamber 1 is arranged in the oil return circuit.

When a piston 2 goes up, the pressure in the crankshaft chamber 5 is reduced, the first check. valve 8 is closed, and oil mist in the upper rocker arm chamber 1 returns to the crankshaft chamber 5 through the oil return circuit and the second check valve 17.

When the piston 2 goes down, the pressure in the crankshaft chamber 5 is increased, the first check valve 8 is opened, and engine oil enters the oil chamber 7 from the crankshaft chamber 5. The pressure in the oil chamber 7 is increased accordingly. The engine oil enters the first lubricating oil circuit 14 through the oil. pipe 24 and enters the cam chamber 3 from the first lubricating oil circuit 14 for lubricating the cam chamber 3. Oil mist enters the upper rocker arm chamber 1 through the tappet hole for lubricating the upper rocker arm chamber 1. When the piston 2 goes up, the pressure in the crankshaft chamber 5 is reduced, the first check valve 8 is closed, and the oil mist in the upper rocker arm chamber 1 returns to the crankshaft chamber 5 through the oil return circuit and the second check valve 17, completing a cycle.

Further, a cylinder head 10 and an inner cylinder head 12 are arranged on the top of the cylinder 13, A top head cavity 11 is arranged between the cylinder head 10 and the inner cylinder head 12. A third lubricating oil circuit 15 with one end communicating with the top head cavity 11 is arranged on the inner cylinder head 12. A second lubricating oil circuit 16 with one end communicating with the other end of the third lubricating oil circuit 15 is arranged in the cylinder 13. The second check valve 1.7 is arranged in the second lubricating oil circuit 16. The second lubricating oil circuit and the third lubricating oil circuit form the oil return circuit. When the piston 2 goes down, the pressure in the crankshaft chamber 5 is increased, the first check valve 8 is opened, and the engine oil enters the oil chamber 7 from the crankshaft chamber 5. The pressure in the oil chamber 7 is increased accordingly. The engine oil enters the first lubricating oil circuit 14 through the oil pipe 24, then enters the cam chamber 3 through the first lubricating oil circuit 14, and then enters the upper rocker arm chamber 1 through the tappet hole. Under the action of pressure, the atomized oil mist further enters the top head cavity 11 from the upper rocker arm chamber 1 through an oil channel. When the piston 2 goes up, the pressure in the crankshaft chamber 5 is reduced, the first check valve 8 is closed, and the oil mist in the top head cavity 11 returns to the crankshaft chamber 5 through the third lubricating oil circuit 15, the second lubricating oil circuit 16 and the second check valve 17 to realize oil return of an oil return channel, completing a cycle. Thus, the pressure in the top head cavity 11 is reduced, the oil flowing out of the engine through the balance pipe 26 is reduced, and the oil consumption of the engine is reduced.

A threshold of the first, second, and third check valves is set to 0.10 MPa.

An oil nozzle 18 is arranged on the first lubricating oil circuit 14. The first lubricating oil circuit 14 is arranged on the crankcase 6. The oil pipe 24 connected to a corresponding port of the first lubricating oil circuit 14 is arranged in the oil chamber 7.

The cross-sectional area of the oil circuit from the inside to the outlet of the oil nozzle 18 is gradually decreased. An expansion port whose cross-sectional area is suddenly enlarged is arranged outside the outlet of the oil circuit of the oil nozzle 18. Such a nozzle structure forms spiral air flow on both sides of a high-speed spray, such that the air and oil are fully mixed to form oil mist. The oil mist can lubricate each moving component, and can also enter the upper rocker arm chamber 1 along with the air flow, such that parts in the upper rocker arm chamber 1 are fully lubricated.

Figure 3:
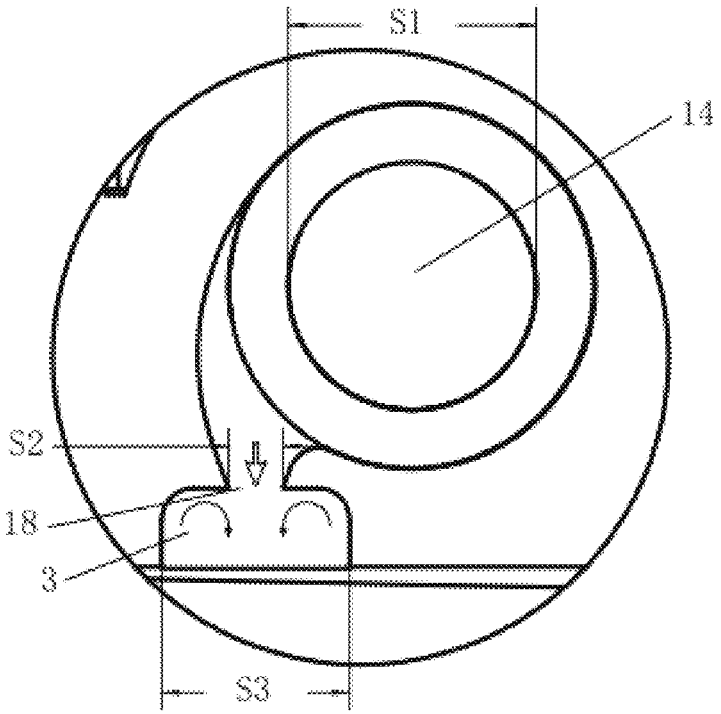
FIG. 3 is an enlarged view of an oil nozzle 18 in FIG. 2.
Figure 4:
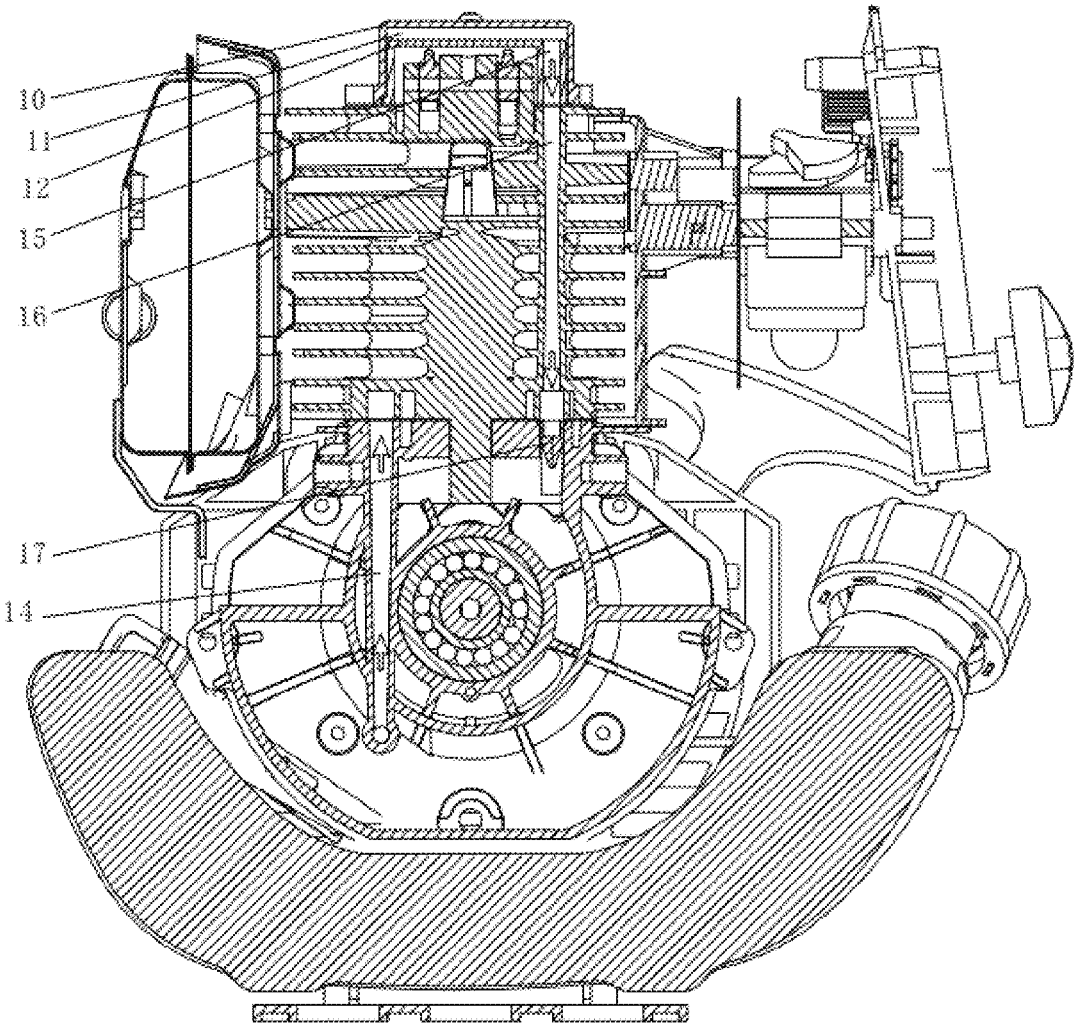
FIG. 4 is a cross sectional view of an engine along the centerline of a lubricating oil circuit of the present disclosure.
Figure 5:
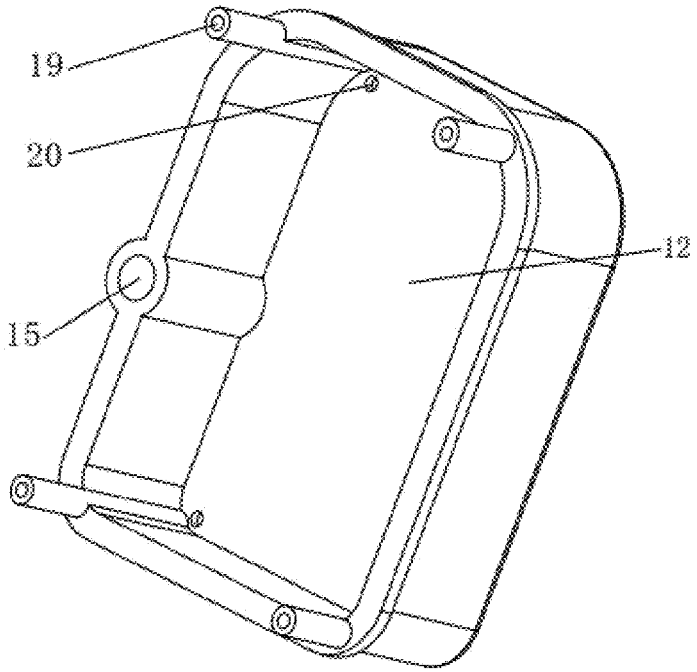
FIG. 5 is a schematic structural diagram of an inner cylinder head of the present disclosure.
Figure 6:
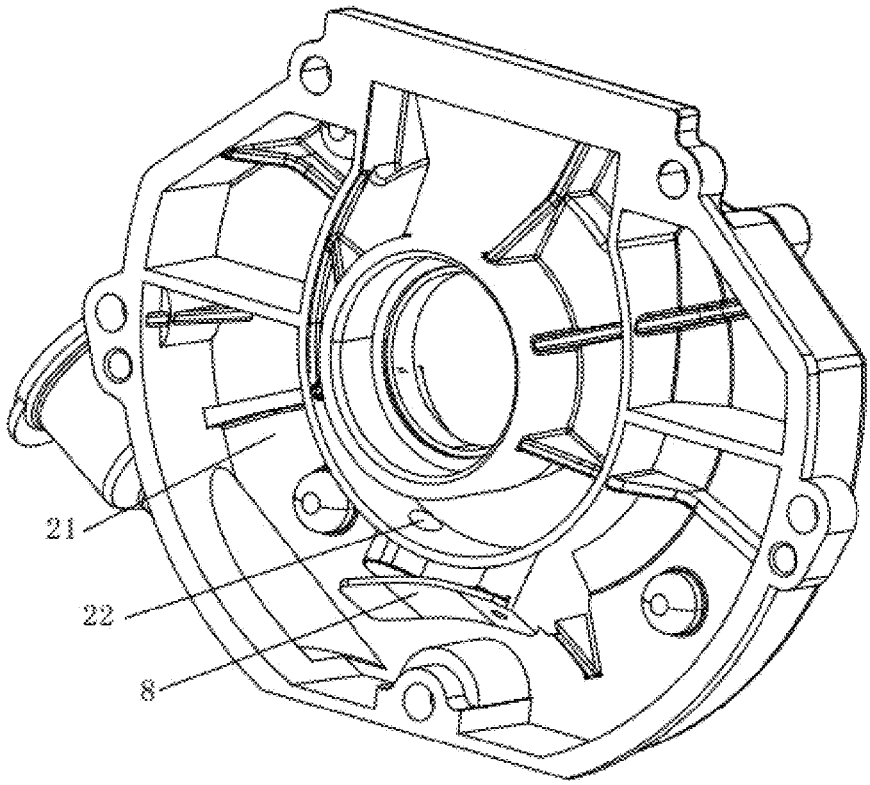
FIG. 6 is a schematic structural diagram of a case cover of the present disclosure.
Figure 7:
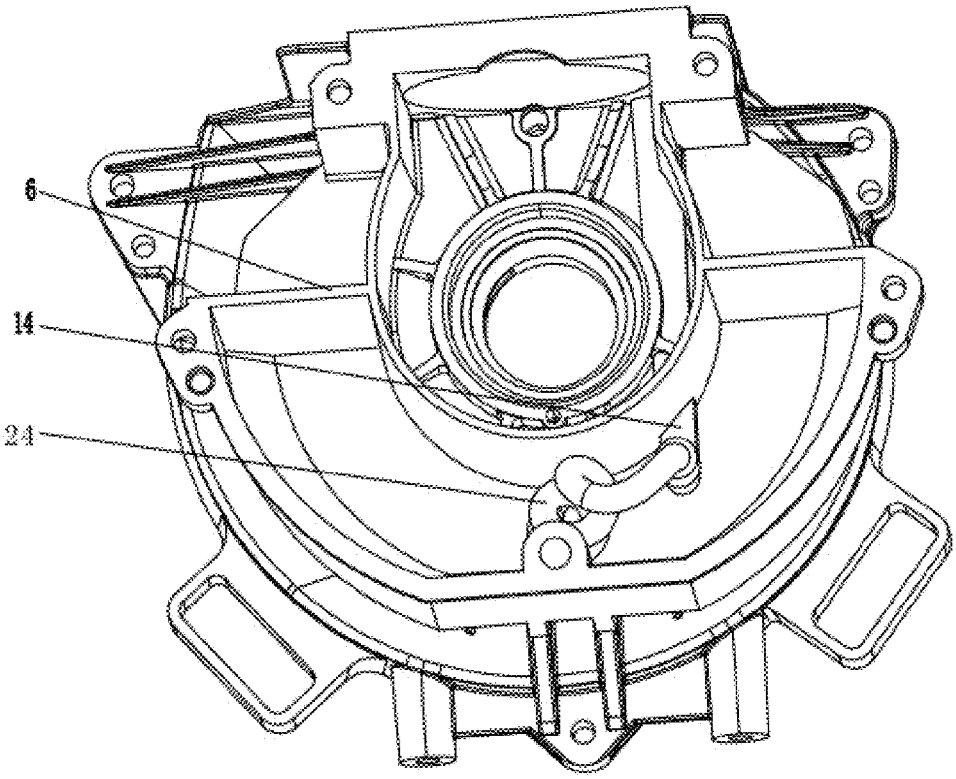
FIG. 7 is an installation diagram of an oil pipe of the present disclosure.
Figure 8:
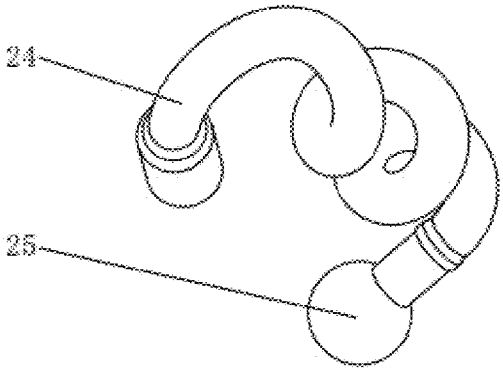
FIG. 8 is a schematic structural diagram of the oil pipe of the present disclosure.

Referring to FIG. 3, the minimum oil circuit cross-sectional area of the first lubricating oil circuit 14 is S1, the minimum oil circuit cross-sectional area of the oil. nozzle 18 is S2, and the oil circuit cross-sectional area of the expansion port of the oil nozzle 18 is S3, S1/S2 is greater than 1.5. S3/S2 is greater than 1.8.

When the piston goes down, as for the pressure in the engine: crankshaft chamber 5>oil chamber 7>first lubricating oil circuit 14>cam chamber 3>upper rocker arm chamber 1>top head chamber 11. When the piston goes up, as for the pressure in the engine: crankshaft chamber 5<second lubricating oil circuit 16<top head cavity 11<upper rocker arm chamber 1<cam chamber 3.

Figure 9:
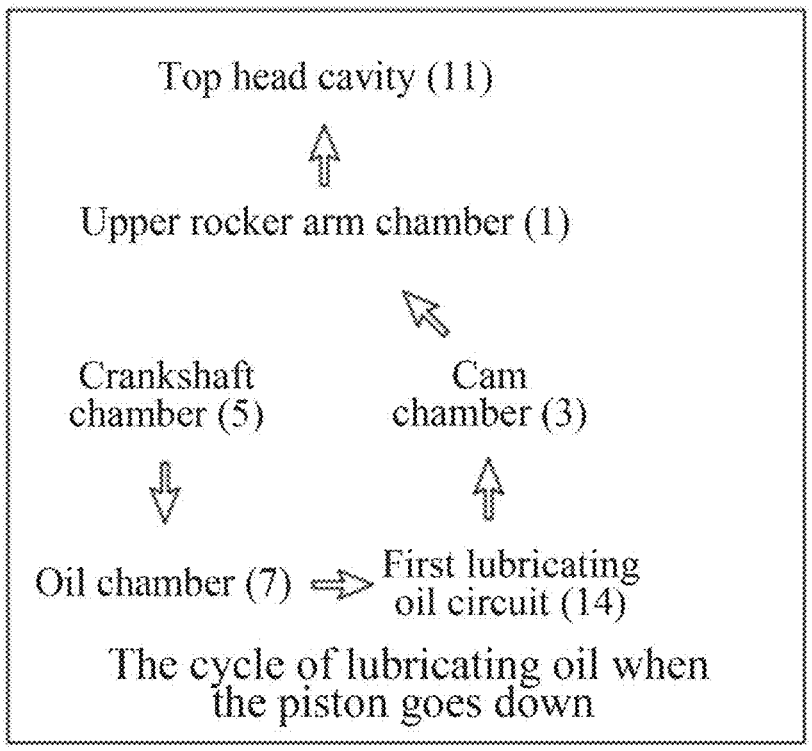
FIG. 9 is a cycle diagram of an oil circuit when a piston goes down of the present disclosure.

During the running of the engine of the present disclosure, referring to FIG. 9, when the piston 2 goes down, the pressure in crankshaft chamber 5 is increased. When the pressure is greater than 0.10 MPa, the first check valve 8 is opened and the oil enters the oil chamber 7 from the crankshaft chamber 5. The pressure in the oil chamber 7 is increased accordingly. The oil enters the first lubricating oil circuit 14 through the spiral oil pipe 24, and is then atomized into the cam chamber 3 through the oil nozzle 18. The atomized oil mist fully lubricates the cam chamber 3. The oil mist enters the upper rocker arm chamber 1 through the tappet hole to fully lubricate the upper rocker arm chamber 1. Under the action of pressure, the atomized oil mist further enters the top head cavity 11 from the upper rocker arm chamber 1 through the oil channel.

Figure 10:
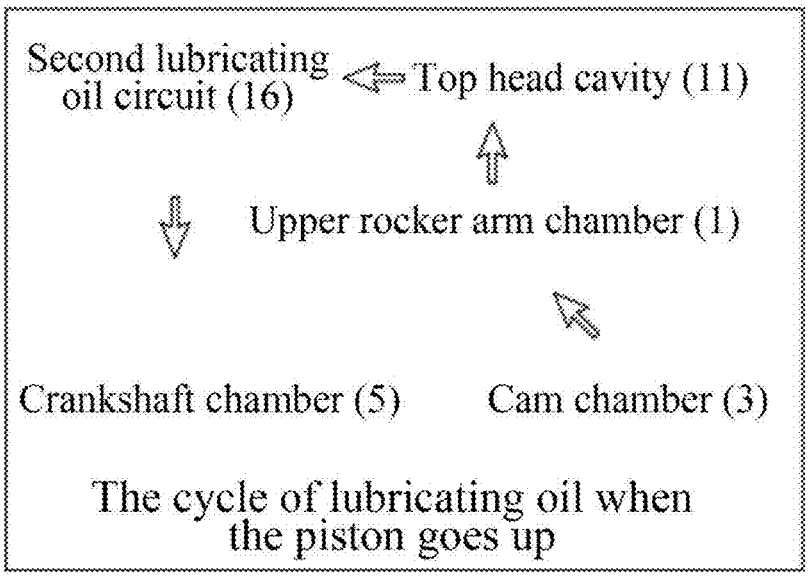
FIG. 10 is a cycle diagram of an oil circuit when the piston goes up the of the present disclosure.
Figure 11:
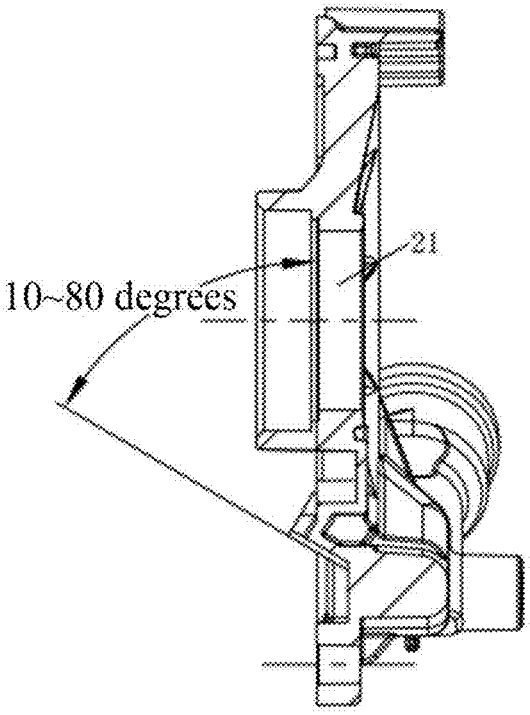
FIG. 11 is a schematic structural diagram of an angle between an installation surface of a first check valve and a case closing surface.
Figure 12:
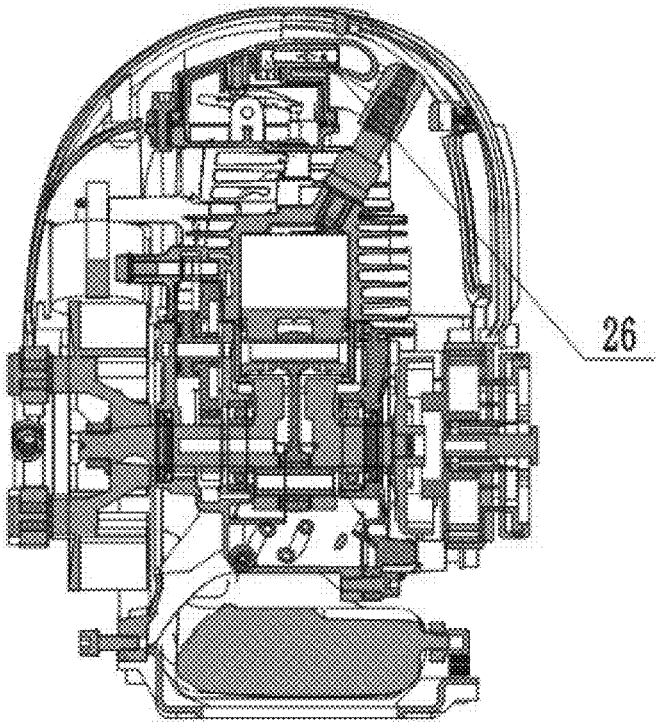
FIG. 12 is a cross sectional view of balance pipe position.

Referring to FIG. 10, as for an oil return channel, when the piston 2 goes up, the pressure in the crankshaft chamber 5 is reduced. When the pressure is less than 0.10 MPa, the first check valve 8 is closed, and the oil mist in the top head cavity 11 returns to the crankshaft chamber 5 through the third lubricating oil circuit 15, the second lubricating oil circuit 16 and the second check valve 17 to realize oil return of the oil return channel, completing a cycle.

Due to the changes of pressure difference, the lubricating oil in the engine begins to circulate to lubricate and cool each component. The cycle diagram of the lubricating oil is shown in FIGS. 9-10.

The first check valve 8 is installed on a case cover 21 arranged on the crankcase 6. A reed installation surface of the first check valve 8 is installed at a certain angle to a case closing surface, with the angle being greater than 10 degrees and less than 80 degrees. A rubber check valve is used as the second check valve 17.

The first check valve 8 is a reed valve. The reed valve is arranged in the oil chamber 7. The crankcase 6 is provided with the case cover 21. The first check valve 8 is installed on the case cover 21. The reed installation surface of the first check valve 8 is installed at a certain angle to the case closing surface, with the angle being greater than 10 degrees and less than 80 degrees, preferably 60 degrees. In this way, the reed valve is easy to open or close to serve as the check valve.

An inlet 22 of the first check valve 8 is arranged on the wall of the crankshaft chamber 5, and an outlet of the first check valve 8 is arranged inside the oil chamber 7. The first lubricating oil circuit 14 is arranged in the crankcase 6.

A third check valve is arranged between the upper rocker arm chamber 1 and an air filter. When the piston 2 goes up, the pressure in the crankshaft chamber 5 is reduced, the first check valve 8 is closed, the oil mist in the upper rocker arm chamber 1 returns to the crankshaft chamber 5 through the oil return circuit and the second check valve 17, the third check valve is closed to disconnect the air filter from the upper rocker arm chamber 1. A threshold for opening the third check valve is set for the third check valve.

At least one oil inlet column 19 is arranged on the inner cylinder head 12. At least one of the oil inlet columns 19 protrudes into the bottom of the upper rocker arm chamber 1. An oil inlet channel that communicates the upper rocker arm chamber 1 and the top head cavity 11 is arranged on the oil inlet column 19. At least one oil inlet hole 20 that communicates the upper rocker arm chamber 1 and the top head cavity 11 is arranged on the top wall of the inner cylinder head 12. The oil inlet column 19 or/and the oil inlet hole 20 form(s) an oil channel that communicates the top head cavity 11 and the upper rocker arm chamber 1.

At least one oil inlet column 19 may be arranged on the inner cylinder head 12. At least one of the oil inlet columns 19 protrudes into the bottom of the upper rocker arm chamber 1. An oil inlet channel that communicates the upper rocker arm chamber 1 and the top head cavity 11 is arranged on the oil inlet column 19. At least one oil inlet hole 20 that communicates the upper rocker arm chamber 1 and the top head cavity 11 is arranged on the top wall of the inner cylinder head 12. The oil inlet column 19 or/and the oil inlet hole 20 form(s) an oil channel that communicates the top head cavity 11 and the upper rocker arm chamber 1.

In this embodiment, there are four oil inlet columns 19. The four oil inlet columns 19 protrude into the bottom of four corners in the upper rocker arm chamber 1. There are four inlet holes 20. Each oil inlet hole 20 is arranged next to each oil inlet column 19.

When the liquid oil accumulates at the bottom of the upper rocker arm chamber 1, the liquid oil enters the top head cavity 11 through the oil inlet channels of the four oil inlet columns 9 and then enters the oil return channel. When the engine is inverted, the liquid oil accumulates inside the cylinder head 10, and the liquid oil enters the top head cavity 11 through the four oil inlet holes 20 and then enters the oil return channel, which can ensure that lubricating oil can always enter the oil return channel regardless of the angle of the engine.

The oil pipe 24 is spiral. One end of the oil pipe 24 is connected to a corresponding end of the first lubricating oil circuit 14. A gravity member 25 is arranged at an oil inlet of the other end.

The oil pipe 24 is a spiral oil pipe. One end of the spiral oil pipe is connected to a corresponding end of the first lubricating oil circuit 14. A gravity member 25 is arranged at an oil inlet of the other end. The spiral oil tube is matched with the gravity member to facilitate the rotation of the oil pipe 24, to ensure that the gravity member 25 can always make the spiral oil pipe rotate to the extent that an oil inlet can be immersed in the oil in the oil chamber 7 at the lower end regardless of the angle of the engine.

One end of the oil pipe 24 is connected to a corresponding end of the first lubricating oil circuit 14, A gravity member 25 is arranged at an oil inlet of the other end. The oil pipe 24 is an oil pipe made of a soft material. The oil pipe made of a soft material may be used alone or combined with the structure of the spiral oil pipe.

The gravity member 25 may be a gravity ball, so that regardless of the position or angle of the engine, the oil inlet of the oil pipe 24 can always be kept at the lowermost part of the oil chamber 7 through the gravity member 25, and the oil inlet of the oil pipe 24 can always be immersed in the oil of the oil chamber 7. Therefore, the engine can be lubricated, cooled, and used thoroughly without dead angle. The oil inlet of the oil pipe 24 may be directly arranged on the gravity member 25. With the oil pipe 24 being a spiral oil pipe, it is more beneficial for the gravity member 25 to keep the oil inlet of the oil pipe 24 to be immersed into the oil in the oil chamber 7.

In order to facilitate the understanding of the method of the present disclosure, the present disclosure also discloses a lubrication system device for implementing the above-mentioned method.

A lubrication system of an engine includes the piston 2, the cam chamber 3, the upper rocker arm chamber 1, the crankcase 6, and the cylinder 13 arranged in the engine, and a crankshaft connecting rod mechanism 4 arranged in the crankcase 6. The crankcase 6 is provided with the crankshaft chamber 5. The oil chamber 7 is arranged on the crankcase 6. The first check valve 8 with the oil circuit unidirectionally leading to the oil chamber 7 from the crankshaft chamber 5 is arranged between the crankshaft chamber 5 and the oil chamber 7.

The first lubricating oil circuit 14 that communicates the oil chamber 7 and the cam chamber 3 is arranged therebetween. The lubricating oil circuit 14 may be arranged separately. In this embodiment, preferably, the first lubricating oil circuit 14 is arranged on the crankcase 6. The cam chamber 3 is communicated with the upper rocker arm chamber 1 through the tappet hole.

The oil chamber 7 is provided with the oil pipe 24 connected to the first lubricating oil circuit 14.

The oil return circuit unidirectionally leading to the crankshaft chamber 5 is arranged between the upper rocker arm chamber 1 and the crankshaft chamber 5. The second check valve 17 is arranged in the oil return circuit.

The threshold preset for the first check valve 8, the second check valve 17, and the third check valve 17 is 0.10 MPa.

When the piston 2 goes down, the pressure in crankshaft chamber 5 is increased. When the pressure is greater than 0.10 MPa, the first check valve 8 is opened and the oil enters the oil chamber 7 from the crankshaft chamber 5. The pressure in the oil chamber 7 is increased accordingly. The oil enters the first lubricating oil circuit 14 through the oil pipe 24, and enters the cam chamber 3 through the first lubricating oil circuit 14 for lubricating the cam chamber 3. The oil mist enters the upper rocker arm chamber 1 through the tappet hole for lubricating the upper rocker arm chamber 1.

When the piston 2 goes up, the pressure in the crankshaft chamber 5 is reduced. When the pressure is less than 0.10 MPa, the first check valve 8 is closed, and the oil mist in the upper rocker arm chamber 1 returns to the crankshaft chamber 5 through the oil return circuit and the second check valve 17, completing a cycle.

The top of cylinder 13 is provided with the cylinder head 10 and the inner cylinder head 12 covering inside the cylinder head 10, The top head cavity 11 is arranged between the cylinder head 10 and the inner cylinder head 12. The oil channel that communicates the top head cavity 11 and the upper rocker arm chamber 1 is arranged on the inner cylinder head 12.

The inlet 22 of the first check valve 8 is arranged on the wall of the crankshaft chamber 5. The outlet of the first check valve 8 is arranged inside the oil chamber 7. The first lubricating oil circuit 14 is positioned in the crankcase 6. The oil nozzle 18 is arranged on the first lubricating oil circuit 14. The second check valve 17 is a rubber check valve.

The return oil circuit includes the third lubricating oil circuit 15 having one end communicating with the top head cavity 11 and arranged on the inner cylinder head 12, and the second lubricating oil circuit 16 having one end communicating with the other end of the third lubricating oil circuit 15 and arranged in the cylinder 13. The second check valve 17 is arranged in the second lubricating oil circuit 16. The other end of the second lubricating oil circuit 16 is communicated with the crankshaft chamber 5.

What is claimed is:

1. A lubricating method of a lubrication system of an engine, wherein an oil chamber (7) is arranged on a crankcase (6), a first check valve (8) with an oil circuit unidirectionally leading to the oil chamber (7) is arranged between a crankshaft chamber (5) and the oil chamber (7), a first lubricating oil circuit (14) is arranged between the oil chamber (7) and a cam chamber (3); the cam chamber (3) is communicated with an upper rocker aim chamber (1) through a tappet hole, an oil nozzle (18) is arranged on the first lubricating oil circuit (14);

an oil return circuit that communicates the upper rocker arm chamber (1) and the crankshaft chamber (5) in the crankcase (6) is arranged on a cylinder (13), and a second check valve (17) which can unidirectionally lead to the crankshaft chamber (5) from the upper rocker arm chamber (1) is arranged in the oil return circuit; and when a piston (2) goes up, the pressure in the crankshaft chamber (5) is reduced, the first check valve (8) is closed, and oil mist in the upper rocker arm chamber (1) returns to the crankshaft chamber (5) through the oil return circuit and the second check valve (17);

wherein threshold values of the first check valve and. the second check valve are set to 0.10 MPa;

a cross-sectional area of the oil circuit from inside to an outlet of the oil nozzle (18) is gradually decreased; a minimum oil circuit cross-sectional area of the first lubricating oil circuit (14) is S1, a minimum oil circuit cross-sectional area of the oil nozzle (18) is S2, and an oil circuit cross-sectional area of an expansion port of the oil nozzle (18) is S3, wherein S1/S2 is greater than 1.5, S3/S2 is greater than 1.8.

2. The lubricating method of a lubrication system of an engine according to claim 1, wherein when the piston (2) goes down, the pressure in the crankshaft chamber (5) is increased, the first check valve (8) is opened, and engine oil enters the oil chamber (7) from the crankshaft chamber (5); the pressure in the oil chamber (7) is increased accordingly, the engine oil enters the first lubricating oil circuit (14) through an oil pipe (24) and enters the cam chamber (3) from the first lubricating oil circuit (14) for lubricating the cam chamber (3), oil mist enters the upper rocker arm chamber (1) through the tappet hole for lubricating the upper rocker arm chamber (1); and when the piston (2) goes up, the pressure in the crankshaft chamber (5) is reduced, the first check valve (8) is closed, and the oil mist in the upper rocker arm chamber (1) returns to the crankshaft chamber (5) through the oil return circuit and the second check valve (17), completing a cycle.

3. The lubricating method of a lubrication system of an engine according to claim 1, wherein a cylinder head (10) and an inner cylinder head (12) are arranged on the top of the cylinder (13), a top head cavity (11) is arranged between the cylinder head (10) and the inner cylinder head (12), and a third lubricating oil circuit (15) with one end communicating with the top head cavity (11) is arranged on the inner cylinder head (12); a second lubricating oil circuit (16) with one end communicating with the other end of the third lubricating oil circuit (15) is arranged in the cylinder (13), the second check valve (17) is arranged in the second lubricating oil circuit (16), and the second lubricating oil circuit and the third lubricating oil circuit form the oil return circuit; when the piston (2) goes down, the pressure in the crankshaft chamber (5) is increased, the first check valve (8) is opened, and the engine oil enters the oil chamber (7) from the crankshaft chamber (5); the pressure in the oil chamber (7) is increased accordingly, the engine oil enters the first lubricating oil circuit (14) through an oil pipe (24) and then enters the cam chamber (3) from the first lubricating oil circuit (14), and the oil mist enters the upper rocker arm chamber (1) through the tappet hole; under the action of pressure, the atomized oil mist further enters the top head cavity (11) from the upper rocker arm chamber (1) through an oil channel; and when the piston (2) goes up, the pressure in the crankshaft chamber (5) is reduced, the first check valve (8) is closed, and the oil mist in the top head cavity (11) returns to the crankshaft chamber (5) through the third lubricating oil circuit (15), the second lubricating oil circuit (16) and the second check valve (17) to realize oil return of an oil return channel, completing a cycle.

4. The lubricating method of a lubrication system of an engine according to claim 3, wherein at least one oil inlet column (19) is arranged on the inner cylinder head (12), at least one of the oil inlet columns (19) protrudes into the bottom of the upper rocker arm chamber (1), and an oil inlet channel that communicates the upper rocker arm chamber (1) and the top head cavity (11) is arranged on the oil inlet col (19); and at least one oil inlet hole (20) that communicates the upper rocker arm chamber (1) and the top head cavity (11) is arranged on the top wall of the inner cylinder head (12), and the oil inlet column (19) or/and the oil inlet hole (20) form(s) an oil channel that communicates the top head cavity (11) and the upper rocker arm chamber (1).

5. The lubricating method of a lubrication system of an engine according to claim 1, wherein the first lubricating oil circuit (14) is arranged on the crankcase (6); and an oil pipe (24) connected to a corresponding port of the first lubricating oil circuit (14) is arranged in the oil chamber (7).

6. The lubricating method of a lubrication system of an engine according to claim 1, wherein a threshold for opening a corresponding check valve is set for the first or/and second check valve(s); and a reed valve is used as the first check valve (8).

7. The lubricating method of a lubrication system of an engine according to claim 1, wherein when the piston (2) goes up, the pressure in the crankshaft chamber (5) is reduced, the first check valve (8) is closed, the oil mist in the upper rocker arm chamber (1) returns to the crankshaft chamber (5) through the oil return circuit and the second check valve (17).

8. The lubricating method of a lubrication system of an engine according to claim 1, wherein the oil pipe (24) is spiral, one end of the oil pipe (24) is connected to a corresponding end of the first lubricating oil circuit (14), and a gravity member (25) is arranged at an oil inlet of the other end.

9. The lubricating method of a lubrication system of an engine according to claim 1, wherein the first check valve (8) is installed on a case cover (21) arranged on the crankcase (6); a reed installation surface of the first check valve (8) is installed at a certain angle to a case closing surface, with the angle being greater than 10 degrees and less than 80 degrees; and a rubber check valve is used as the second check valve (17).

10. The lubricating method of a lubrication system of an engine according to claim 1, wherein an inlet (22) of the first check valve (8) is arranged on the wall of the crankshaft chamber (5), and an outlet of the first check valve (8) is arranged inside the oil chamber (7); the first lubricating oil circuit (14) is arranged in the crankcase (6).

* * * * *